US009162813B2

(12) United States Patent
Noble

(10) Patent No.: US 9,162,813 B2
(45) Date of Patent: Oct. 20, 2015

(54) PACIFIER HOLDER AND PROTECTOR

(71) Applicant: Lorri B Noble, Wetumpka, AL (US)

(72) Inventor: Lorri B Noble, Wetumpka, AL (US)

( * ) Notice: Subject to any disclaimer, the term of this patent is extended or adjusted under 35 U.S.C. 154(b) by 33 days.

(21) Appl. No.: 13/622,340

(22) Filed: Sep. 18, 2012

(65) Prior Publication Data

US 2013/0089276 A1 Apr. 11, 2013

Related U.S. Application Data

(60) Provisional application No. 61/536,438, filed on Sep. 19, 2011, provisional application No. 61/577,584, filed on Dec. 19, 2011.

(51) Int. Cl.

| | |
|---|---|
| ***A45F 5/00*** | (2006.01) |
| ***A61J 17/00*** | (2006.01) |
| ***B65D 85/00*** | (2006.01) |

(52) U.S. Cl.

CPC ..... *B65D 85/00* (2013.01); *A61J 17/00* (2013.01); *A61J 1/1418* (2015.05); *A61J 17/007* (2015.05); *A61J 17/008* (2015.05)

(58) Field of Classification Search

CPC ..... A61J 17/00; A61J 2017/008
USPC ..... 224/269; 606/234, 236
See application file for complete search history.

(56) References Cited

U.S. PATENT DOCUMENTS

| | | | | | |
|---|---|---|---|---|---|
| 3,392,729 | A | * | 7/1968 | Lenoir | 606/234 |
| 4,946,054 | A | * | 8/1990 | Maniero et al. | 215/11.6 |
| 5,156,617 | A | * | 10/1992 | Reid | 606/234 |
| D340,287 | S | * | 10/1993 | Hines | D24/194 |
| 5,606,871 | A | * | 3/1997 | Hansen et al. | 62/457.5 |
| 5,964,784 | A | * | 10/1999 | Wang | 606/234 |
| D423,675 | S | * | 4/2000 | Ramos, IV | D24/194 |
| 6,634,919 | B2 | * | 10/2003 | Gordon et al. | 446/73 |
| 6,638,298 | B1 | | 10/2003 | Shefflin | |
| D552,248 | S | * | 10/2007 | Brawley | D24/199 |
| 2008/0177305 | A1 | * | 7/2008 | Vath et al. | 606/234 |
| 2009/0081921 | A1 | * | 3/2009 | Urueta | 446/369 |
| 2010/0082063 | A1 | * | 4/2010 | Yacktman et al. | 606/234 |
| 2011/0266319 | A1 | * | 11/2011 | Jaegar-Waldau et al. | 224/269 |

* cited by examiner

*Primary Examiner* — Brian D Nash
*Assistant Examiner* — Derek Battisti
(74) *Attorney, Agent, or Firm* — Larry W. Brantley; Blake M. Bernard; Waller Lansden Dortch & Davis

(57) ABSTRACT

A pacifier holder and protector for protecting a pacifier from dirt and other contaminants includes a pouch, a clip connected to the pouch that can be used to connect the holder to an infant's clothing or other item, and a ribbon having one end connected to the pouch and a second end that can be connected to a pacifier. An alternative embodiment of the holder and protector includes an animal character, fictional character, or other object having a built-in pacifier nipple protector connected to a clip or article of clothing and an optional ribbon or strap having one end connected to the clip of other article of clothing and a second end that can be connected to a pacifier.

10 Claims, 7 Drawing Sheets

PACIFIER HOLDER AND PROTECTOR

CROSS-REFERENCE TO RELATED APPLICATIONS

The present application is a nonprovisional patent application of U.S. provisional patent application Ser. No. 61/536,438, filed on Sep. 19, 2011 and entitled "Pacifier Clip with Attached Paci Pouch" and U.S. provisional patent application Ser. No. 61/577,584, filed on Dec. 19, 2011 and entitled "Pacifier Clip/Holder with a Built-In Nipple Protector." The '438 and '584 applications are hereby incorporated by reference into the present application.

BACKGROUND OF THE INVENTION

The present invention relates generally to a pacifier holder. More specifically, the present invention pertains to a pacifier holder and protector.

Pacifier holders are known in the art. These holders typically include a ribbon having one end that can be connected to a pacifier and a second end that can be connected to an infant's clothing using a clip. When the pacifier is not being used, the pacifier simply hangs from the ribbon and is exposed to dirt and other contaminants, which is harmful to an infant. As a result, there is a need for a way to hold a pacifier when it is not in use that eliminates this problem.

SUMMARY OF THE INVENTION

The present invention solves this problem by providing a pacifier holder and protector that can be used to protect a pacifier from dirt and other contaminants. In one embodiment, the pacifier holder and protector includes a pouch sized to receive and hold a pacifier, a ribbon having one end that can be connected to the pouch and a second end that can be connected to a pacifier, and a clip connected to the pouch that can be used to connect the pacifier holder to an infant's clothing or other item. A pacifier is protected from dirt and other contaminants when it is placed inside the pouch. In another embodiment, the pacifier holder and protector includes an animal character, fictional character, or other object having a built-in pacifier nipple protector, a clip connected to the animal character, fictional character, or other object, and an optional ribbon having one end connected to the animal character, fictional character, or other object or the clip and a second end that can be connected to a pacifier. In still another embodiment, the pacifier holder and protector includes an animal character, fictional character, or other object having a built-in pacifier nipple protector, a bib or other item of clothing connected to the animal character, fictional character, or other object, and an optional ribbon having one end connected to the bib or other item of clothing and a second end that can be connected to a pacifier. In both of these last two embodiments, the nipple of a pacifier is protected from dirt and other contaminants when it is inserted inside and held by the built-in pacifier nipple protector.

DETAILED DESCRIPTION OF THE INVENTION

Figure 1:
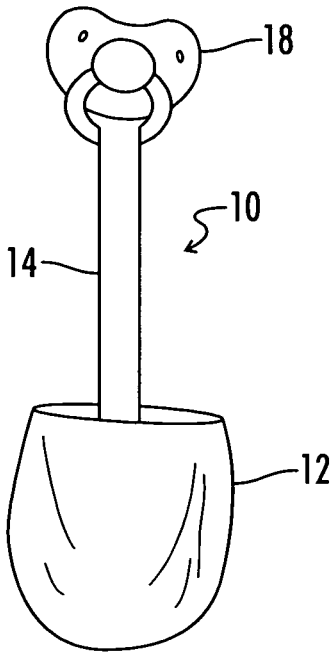
FIG. 1 is front view of one embodiment of the pacifier holder and protector of the present invention.
Figure 2:
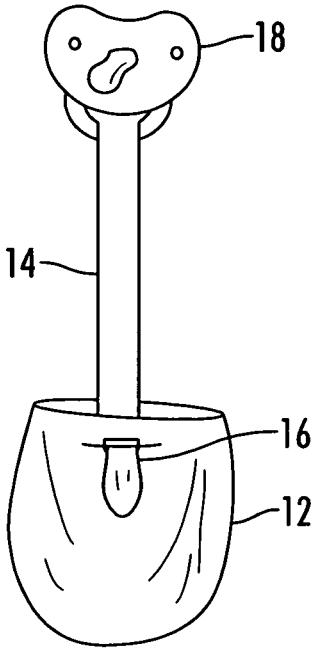
FIG. 2 is a back view of the embodiment shown in FIG. 1.
Figure 3:
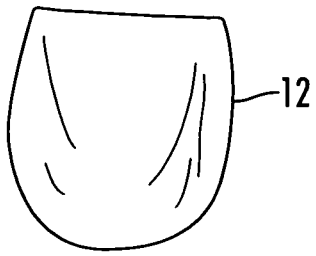
FIG. 3 is a front view of the embodiment shown in FIG. 1 with the pacifier inside the pacifier holder and protector.
Figure 4:
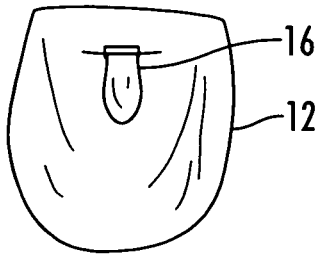
FIG. 4 is a rear view of the embodiment shown in FIG. 3.
Figure 5:
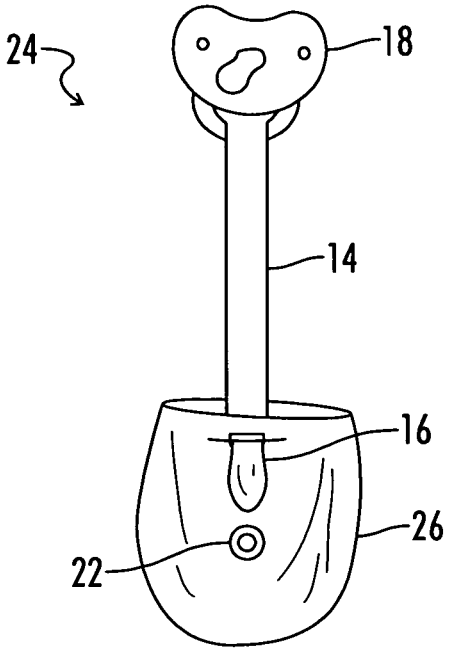
FIG. 5 is a rear view of a second embodiment of the pacifier holder and protector of the present invention.
Figure 6:
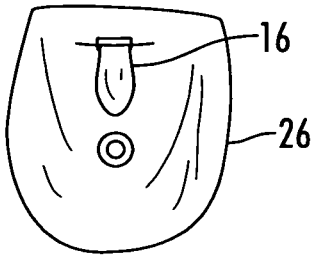
FIG. 6 is a rear view of the embodiment shown in FIG. 5 with the pacifier inside the pacifier holder and protector.
Figure 7:
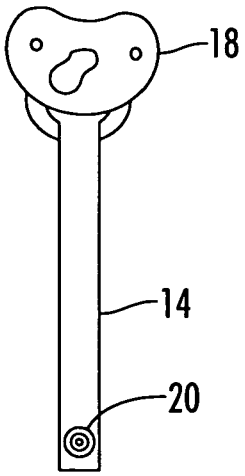
FIG. 7 is a front view showing one embodiment of a ribbon used with the present invention.

A first embodiment of the present invention, pacifier holder and protector 10, is shown in FIGS. 1-4. This embodiment includes a pouch 12, a ribbon 14 having a first end connected to an inner portion of the pouch 12 and a second end connected to pacifier 18, and a clip 16 extending outward from a rear upper portion of the pouch 12. The first end of the ribbon 14 may be stitched to the inner portion of the pouch 12 or, in a second embodiment (pacifier holder 24 in FIGS. 5-6), may be connected to the inner portion of a pouch 26 using a male portion 20 of a snap located on the first end of the ribbon (FIG. 7) and a female portion 22 of a snap located on the inner portion of the pouch 26 (FIGS. 5-6).

Pouches 12 and 26 may include magnetic strips or fabric hook and loop fasteners like Velcro (not shown) that can be used to open and close the pouches. As shown in FIGS. 3-4, and 6, the pacifier 18 may be placed inside and completely enclosed by the pouches 12 and 26.

The clip 16 can be used to connect the pacifier holder and protector 10 to an infant's clothing or other item. The clip 16 is located on a rear upper portion of the pouch 12 (and pouch 26) in order to prevent the pacifier holder and protector 10 (and pacifier holder and protector 24) from falling upside down when the pacifier 18 and ribbon 14 are secured inside the pouch 12 (and pouch 26).

Figure 8:
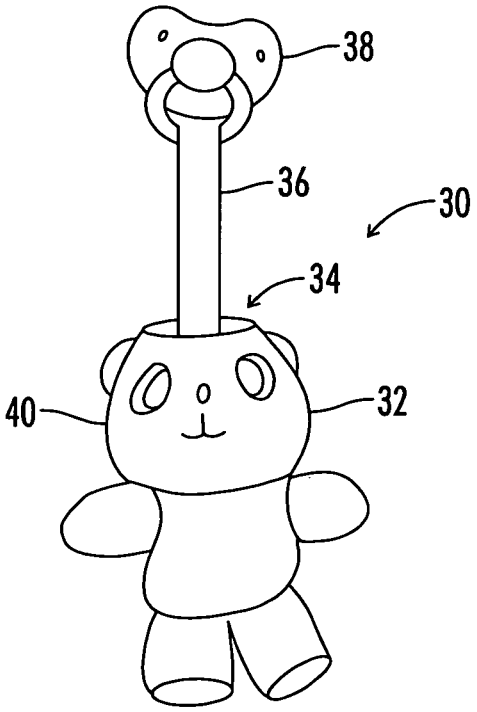
FIG. 8 is a front view of a third embodiment of the present invention.
Figure 9:
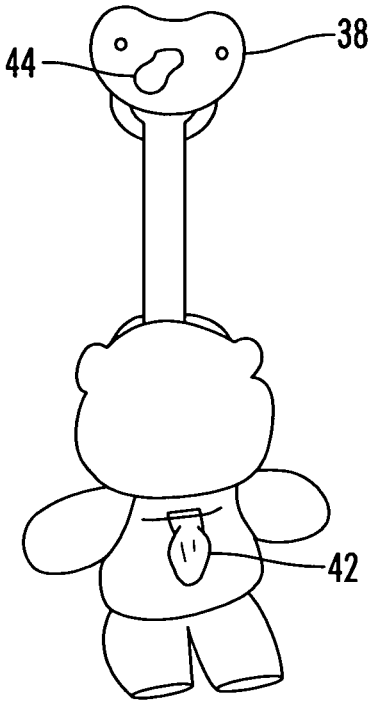
FIG. 9 is rear view of the embodiment shown in FIG. 8.
Figure 10:
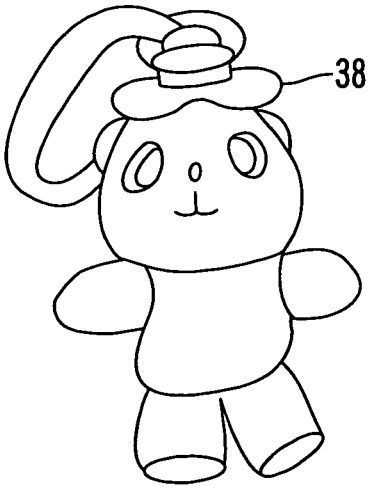
FIG. 10 is a front view of the embodiment shown in FIG. 8 with the pacifier nipple inside the pacifier holder and protector.
Figure 11:
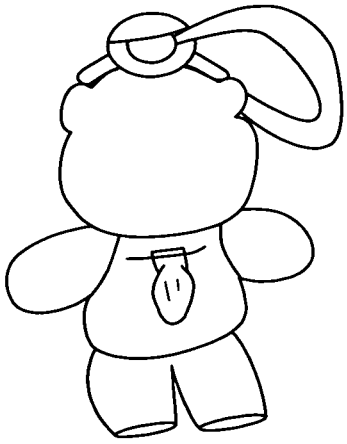
FIG. 11 is a rear view of the embodiment shown in FIG. 10.

A third embodiment of the present invention, pacifier holder and protector 30, is shown in FIGS. 8-11 and includes an animal FIG. 32 having a built-in pacifier nipple protector 34, a ribbon or strap 36 having a first end connected to an inner portion of the animal FIG. 32 and a second end that can be connected to a pacifier 38 using a snap or fabric hook and loop fastener, and a clip 42 extending outward from a rear upper portion of the animal FIG. 32. As shown in FIG. 8, the pacifier nipple protector 34 may be included in the head 40 of the animal FIG. 32. The clip 42 can be used to connect the pacifier holder 30 to an infant's clothing or other item. Pacifier 38 includes a nipple 44 (FIG. 9), which can be placed inside and held by pacifier nipple protector 34 (FIGS. 10-11).

Figure 12:
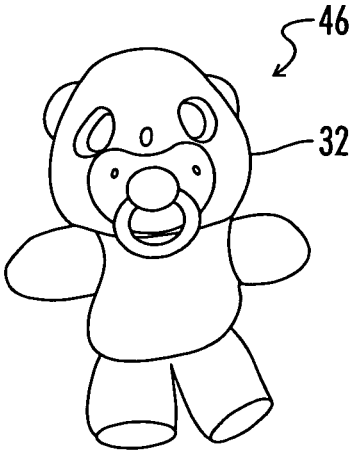
FIG. 12 is a front view of a fourth embodiment of the present invention.
Figure 13:
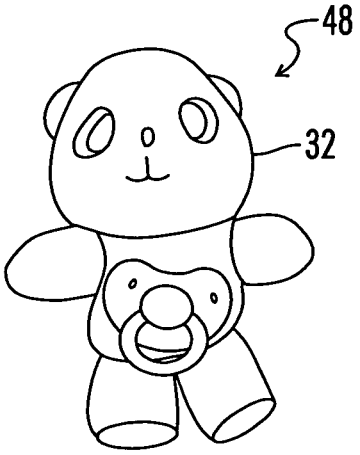
FIG. 13 is a front view of a fifth embodiment of the present invention.

FIGS. 12 and 13 show fourth and fifth embodiments of the present invention. In FIG. 12, pacifier holder and protector 46 includes a pacifier nipple protector that is located in the mouth of the animal FIG. 32 and, in FIG. 13, the pacifier nipple protector is located in the stomach of animal FIG. 32. In other embodiments, the pacifier nipple protector may be located in other areas as well, e.g., arm, leg, ear, etc. The embodiments shown in FIGS. 12-13 do not include the ribbon or strap 36.

Although the animal figure shown in FIGS. 8-13 is a bear, alternative embodiments of the pacifier holder and protector of the present invention may include various other animal characters or fictional characters, as well other various shaped objects, e.g., just the head of the animal figure, a purse, a pouch, a pocket, headgear, clothing, a sports ball, etc.

In some embodiments, the first end of the ribbon or strap 36 may pass through the animal character, fictional character, or other object, with the clip being attached to the first end rather than the rear portion of the animal figure, fictional character, or other object.

Figure 16:
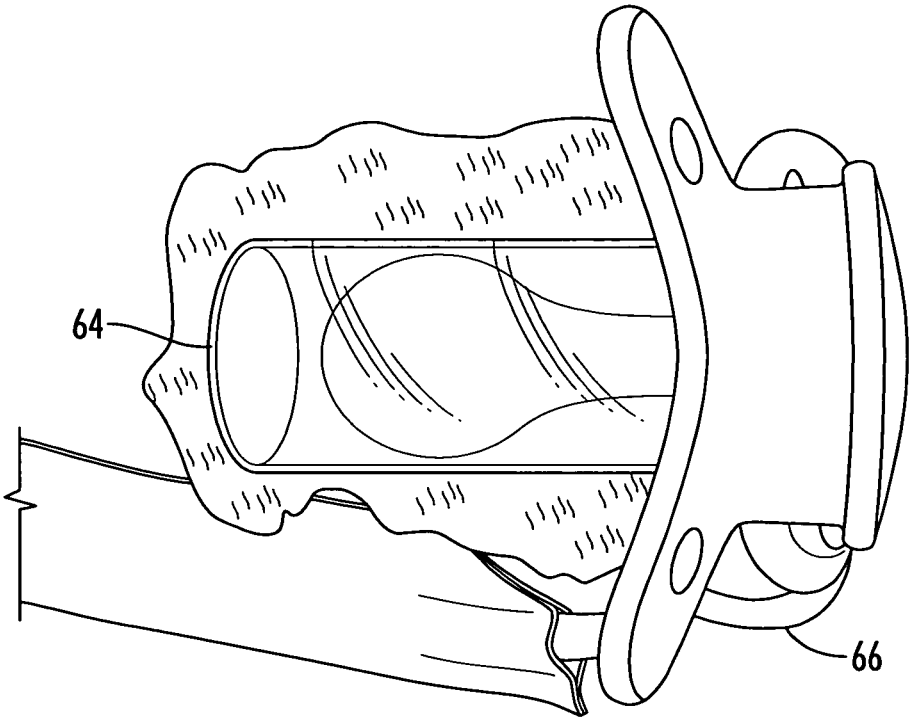
FIG. 16 is an enlarged view showing how a pacifier nipple fits inside one embodiment of the built-in pacifier nipple protector.
Figure 17:
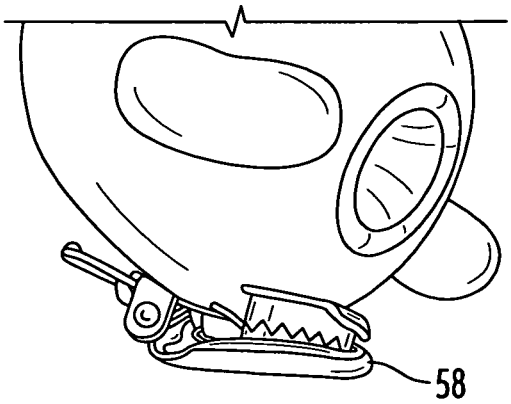
FIG. 17 is an enlarged view showing the clip included in the embodiment shown in FIG. 14.

A sixth embodiment of the present invention, pacifier holder and protector 50, is shown in FIGS. 15-18. This embodiment includes an animal figure head 52 having a built-in pacifier nipple protector 60, a clip 58 connected to and extending outward from a rear portion of the animal figure head 52, a ribbon 54 having one end connected to the clip 58 using a snap 59 and a second end connected to a pacifier 56 using a pacifier handle 57. Built-in pacifier nipple protector 60 includes a cloth portion 62 (FIG. 15) covering a piece of flexible cylindrical silicone 64 (FIG. 16).

The shape of the built-in pacifier nipple protector 60 can be varied to accommodate pacifier nipples having various sizes by squeezing the built-in pacifier nipple protector 60, which causes the diameter of the flexible cylindrical silicone 64 to become smaller, or by inserting fingers or other objects into the built-in pacifier nipple protector, which causes the diameter of the flexible cylindrical silicone 64 to become larger. The use of flexible silicone allows the built-in pacifier nipple protector to retain its shape when it has been varied in this manner.

Figure 14:
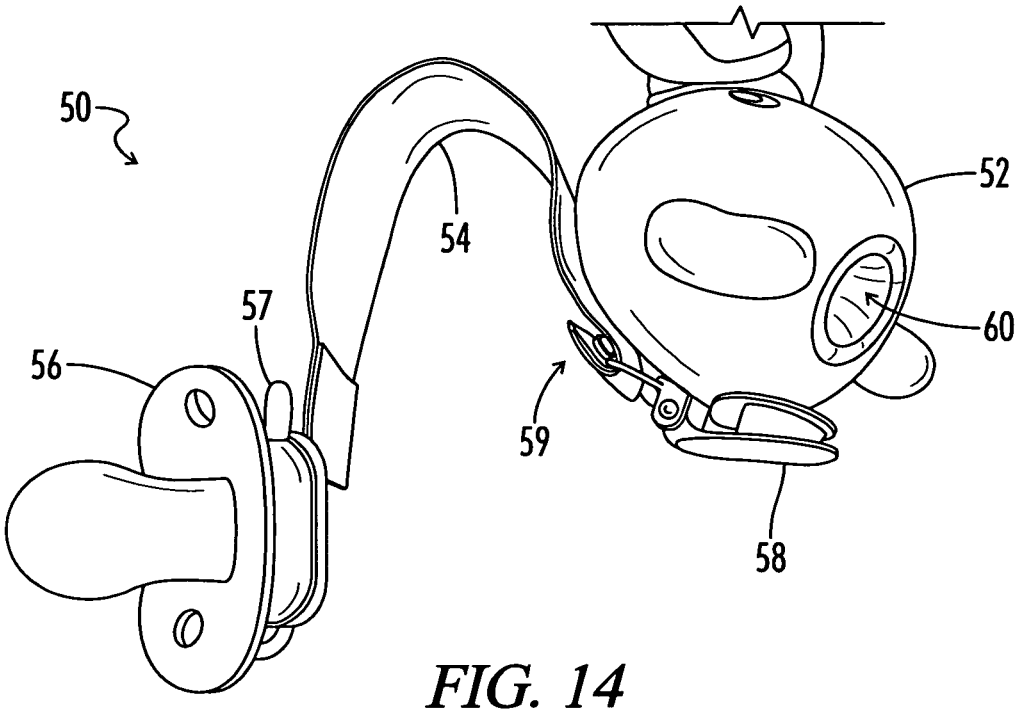
FIG. 14 is a side view of a sixth embodiment of the present invention.
Figure 15:
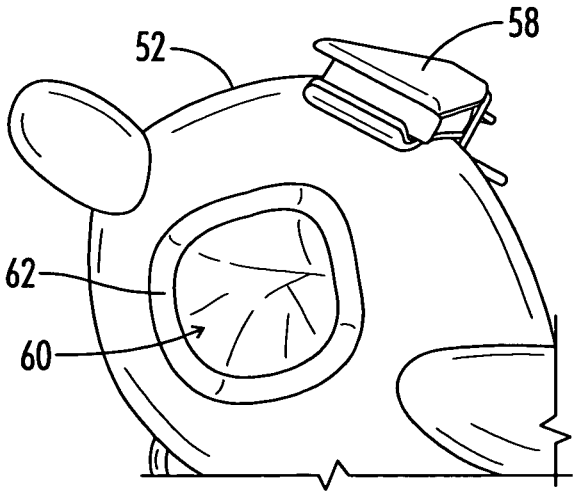
FIG. 15 is an enlarged view of the embodiment shown in FIG. 14 showing the built-in pacifier nipple protector.
Figure 18:
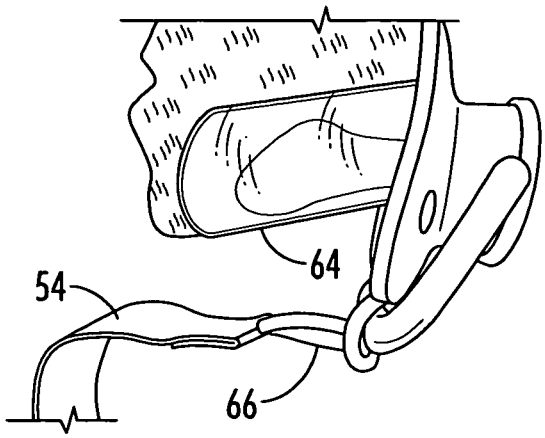
FIG. 18 is enlarged view showing the ribbon included in the embodiment shown in FIG. 14 connected to the pacifier handle.

The second end of ribbon 54 is connected to pacifier handle 57 using a piece of looped thread 66 (FIG. 18). Clip 58 is a conventional clip and any one of a variety of different clips may be used instead. In addition, although the animal figure head 52 shown in FIG. 14 is a bear head, other embodiments may use other types of heads as well.

Figure 19:
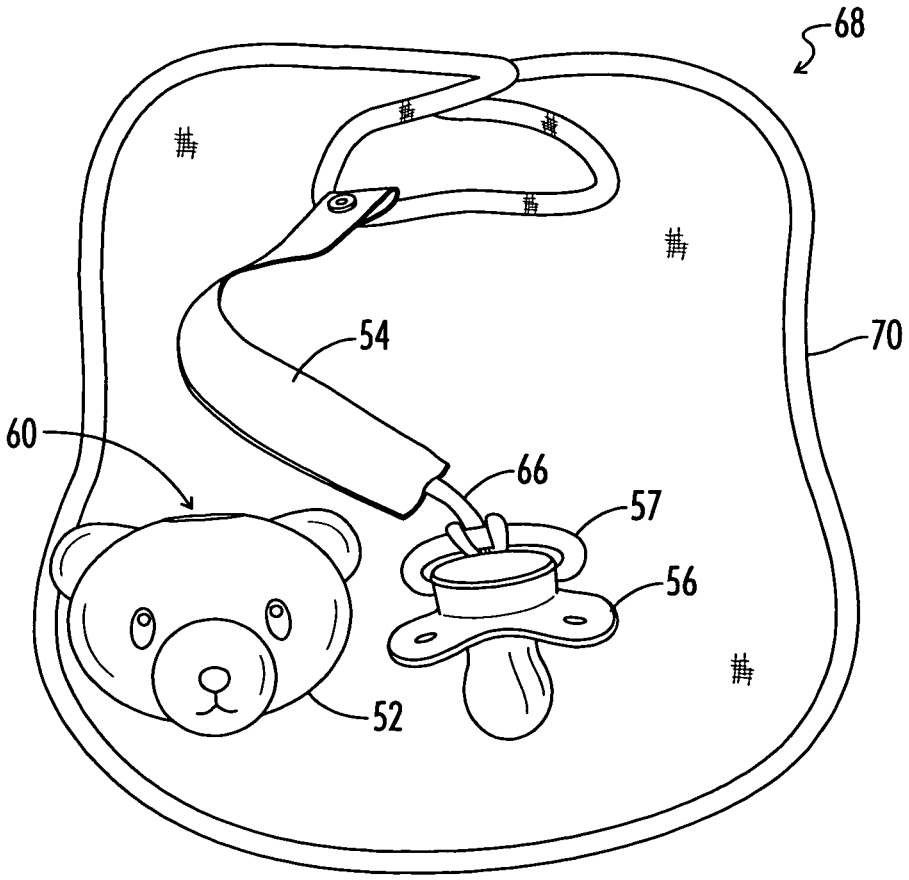
FIG. 19 is a front view showing a seventh embodiment of the pacifier holder and protector of the present invention.

A seventh embodiment of the present invention, pacifier holder and protector 68, is shown in FIG. 19. This embodiment is similar to the sixth embodiment except that the clip 58 has been removed, animal figure head 52 is connected to bib 70, and the first end of ribbon 54 is connected to bib 70.

The above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

What is claimed is:

1. A pacifier holder and protector assembly, comprising:

a pacifier including a nipple and a handle;

an animal figure head including a built-in pacifier nipple protector disposed therein and an upper opening extending into the built-in pacifier nipple protector, the built-in pacifier nipple protector disposed in a top portion of the animal figure head and sized to receive and protect only the nipple of the pacifier; and a clip connected to a rear portion of the animal figure head that can be used to connect the holder to an infant's clothing or other item;

wherein the upper opening is sized such that the nipple is receivable by and insertable through the upper opening without the animal figure head being opened.

wherein when the nipple of the pacifier is inserted through the upper opening and into the built-in pacifier nipple protector, the handle of the pacifier is not enclosed by the built-in pacifier nipple protector and is in contact with the upper opening; wherein the built-in pacifier nipper protector includes flexible silicone and is cylindrical in shape.

2. The assembly of claim 1, further comprising a ribbon or strap having a first end connected to the animal figure head, and a second end having a snap, fabric hook and loop fastener, or loop of material that can be used to connect the ribbon or strap to the pacifier.

3. The assembly of claim 2, wherein the pacifier nipple is disposed within and held by the built-in pacifier nipple protector and wherein the second end of the ribbon or strap is connected to the pacifier using a snap or fabric hook and loop fastener.

4. The assembly of claim 1, wherein the cylindrical shape of the built-in pacifier nipple protector can be changed to accommodate nipples having various sizes.

5. The assembly of claim 3, wherein the second end of the ribbon or strap is connected to the handle of the pacifier.

6. The assembly of claim 1, further comprising a ribbon or strap having a first end connected to the animal figure head, and a second end having a snap, fabric hook and loop fastener, or loop of material connected to the clip.

7. A pacifier holder and protector assembly, comprising:

a pacifier including a nipple and a handle:

a bib;

an animal figure head having a built-in pacifier nipple protector connected to the bib, the animal figure head having an upper opening extending into the built-in pacifier nipple protector, the built-in pacifier nipple protector disposed in a top portion of the animal figure head and sized to receive and protect only the nipple of the pacifier; and a ribbon or strap having a first end connected to the bib and a second end connected to the pacifier;

wherein the animal figure head is one unitary piece without a hinge that is not movable between an open position and a closed position, and the upper opening is sized such that the nipple is receivable by and insertable through the upper opening without the animal figure head being opened;

wherein when the nipple of the pacifier is inserted through the upper opening and into the built-in pacifier nipple protector, the handle included with the pacifier is not inserted into or enclosed by the built-in pacifier nipple protector and is in contact with the upper opening; wherein the built-in pacifier nipper protector includes flexible silicone and is cylindrical in shape.

8. The assembly of claim 7, wherein the built-in pacifier nipple protector includes a piece of flexible, cylindrical silicone covered by a piece of cloth and the animal figure head is a bear head.

9. The assembly of claim 8, wherein the built-in pacifier nipple protector has a shape that can be varied to fit different sized pacifier nipples by squeezing or inserting an object into the built-in pacifier nipple protector.

10. The assembly of claim 9, wherein the second end of the ribbon or strap includes a piece of looped thread, and the second end of the ribbon or strap is connected to the handle using the piece of looped thread.

* * * * *